9/3/85 XR 4,539,144

United States Patent [19]

de Ridder et al.

[11] Patent Number: 4,539,144

[45] Date of Patent: Sep. 3, 1985

[54] DISHWASHING COMPOSITIONS WITH AN ANTI-FILMING POLYMER

[75] Inventors: Johannes J. M. de Ridder, Hilversum, Netherlands; Michael W. Hollingsworth; Ian D. Robb, both of Wirral, England

[73] Assignee: Lever Brothers Company, New York, N.Y.

[21] Appl. No.: 450,944

[22] Filed: Dec. 20, 1982

[30] Foreign Application Priority Data

Dec. 23, 1981 [GB] United Kingdom ..... 8138735

[51] Int. Cl.[3] ..... C11D 1/08; C11D 3/08

[52] U.S. Cl. ..... 252/526; 252/95; 252/99; 252/102; 252/135; 252/174.13; 252/174.16; 252/174.19; 252/174.25; 252/527; 252/545; 252/546

[58] Field of Search ..... 252/95, 99, 135, 174.19, 252/174.24, DIG. 2, 102, 545, 527, 174.25, 174.16, 526

[56] References Cited

U.S. PATENT DOCUMENTS

| | | | |
|---|---|---|---|
| 3,627,686 | 9/1968 | Sabatelli et al. | 252/527 |
| 3,700,599 | 10/1972 | Mizuno et al. | 252/99 |
| 3,846,346 | 11/1974 | Conn | 252/527 |
| 4,203,858 | 5/1980 | Chakrabarti | 252/135 |
| 4,284,524 | 8/1981 | Gilbert | 252/99 |
| 4,306,987 | 12/1981 | Kaneko | 252/99 |

*Primary Examiner*—Prince E. Willis

*Attorney, Agent, or Firm*—Lynne Darcy; James J. Farrell

[57] ABSTRACT

The present invention pertains to a machine dishwashing or rinsing composition being substantially free from anionic synthetic detergents or fatty acid soaps, and having a very low or zero phosphate content, which comprises a nonionic detergent surfactant, a water-soluble calcium sequestering agent, a specific polymeric material and an alkaline detergent material, said composition having improved non-filming, non-spotting or non-streaking properties.

4 Claims, No Drawings

DISHWASHING COMPOSITIONS WITH AN ANTI-FILMING POLYMER

The present invention relates to dishwashing compositions with reduced filming properties.

In the area of dishwashing it is well-known that the use of hard water can cause a filming problem on the objects to be cleaned. This filming results in a dull surface of the cleaned objects when dry. The cause of this filming problem is generally accepted to be due to the $Ca^{2+}$ ions in solution, which can precipitate as insoluble salts, through interaction with certain ingredients of a dishwashing composition and deposit on the surface of the objects or of the dishwashing machine parts.

To prevent this precipitation of insoluble calcium salts on to the surfaces of the objects to be cleaned, many proposals have already been made. Most of these proposals involve sequestration of the water hardness ions by the use of suitable sequestering agents. For this purpose commonly the phosphate builder salts are used. However, since phosphate builder salts are believed to contribute to eutrophication, there is a clear tendency to reduce the phosphate builder content in detergent compositions, including dishwashing compositions, and such formulations with a reduced phosphate content have an increased tendency to cause filming as described above. This is particularly true for formulations in which the reduction of the phosphate builder salts is compensated by the addition of non-phosphate builder salts, such as for instance sodium carbonate.

It is an object of the present invention to provide a dishwashing composition with a very low or zero phosphate content, which does not produce the above hard water filming to any significant degree.

It has now been found that the inclusion of certain polymers in such dishwashing compositions does significantly prevent the filming on the surface of the articles to be cleaned or on the machine parts of the dishwashing machine.

The inclusion of polymers in dishwashing compositions is not unknown in the prior art. Thus, in U.S. Pat. No. 3,700,599 it has been proposed to use a copolymer of maleic anhydride with vinylacetate or a polyacrylamide or an ethylene/maleic anhydride copolymer or a sulphonated polyacrylic acid in a dishwashing composition with an alkaline detergent salt and an alkali metal citrate. This composition may not contain more than 10% (of the alkaline detergent salt) of alkali metal polyphosphates. The polymer together with the citrate salt functions as a substitute for the polyphosphates. The polymers have an apparent chelation value of at least 200 mg of $CaCO_3$ sequestered per gram of polymer.

In U.S. Pat. No. 3,579,455 it has been proposed to include an alkali metal polyacrylate in a dishwashing composition containing an alkali metal carbonate, a pyrophosphate and a hexametaphosphate. The polyacrylate has an average molecular weight of 1,000 to 200,000.

In U.S. Pat. No. 3,764,559 it is proposed to include a copolymer of maleic anhydride and vinylacetate in a dishwashing composition comprising a non-phosphate detergent salt, optionally also a phosphate salt.

In U.S. Pat. No. 3,887,480 it is proposed to include a polymer, prepared from the monomers of maleic anhydride, vinylacetate and acrylic or methacrylic acid, in a dishwashing composition.

Recently, it has been suggested in U.S. Pat. No. 4,203,858 to include, in an alkali metal carbonate-based dishwashing composition, a low molecular weight polyelectrolyte which is a polyacrylate, a polymethacrylate or their copolymers, having a molecular weight of 504 to 1291. By the use of these polyelectrolytes in carbonate-containing compositions it is stated that less spotting and filming occur.

In British Pat. No. 1,398,263 it is disclosed to use a calcium-sequestrant and a calcium-carbonate antideposition agent in a carbonate-built detergent composition.

Finally, in British Pat. No. 1,491,978 it has been suggested to prevent the deposition of insoluble inorganic salts from a fabric washing liquor by inclusion in a detergent composition of a small amount of a hydrolyzed polymaleic anhydride with a molecular weight of 300 to 5000 or a hydrolysed copolymer of maleic anhydride with a monoethylenically unsaturated monomer, the copolymer having a molecular weight of 300 to 1000.

Thus, the prior art has suggested using relatively low molecular weight polymers in cleaning compositions to prevent filming or to prevent deposition of inorganic insoluble salts from hard water.

The present invention has especially as an object to improve the performance of such compositions which comprise a relatively low molecular weight polymer.

It has now been found that the addition of $Ca^{2+}$ sequestering agents to a dishwashing composition having a very low or zero phosphate content and containing a particular, relatively low molecular weight polymer as hereinafter defined significantly improves the non-filming and non-spotting or non-streaking properties of the dishwashing composition. In comparison with the prior art formulations, significantly less of the polymer and of the sequestering agent is required in the compositions of the invention than would be expected on the basis of the sum of the effects of each of the individual components, i.e. the polymer or the sequestering agent.

The polymer to be used in the present invention is a polymeric material having an average molecular weight of between about 500 and about 3,000 and having in its molecular structure the group

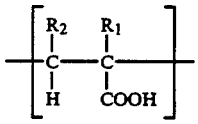

optionally together with the group

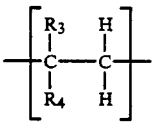

in which $R_1$ is hydrogen, or a hydroxyl group; $R_2$ is hydrogen, an alkyl or alkoxy group having from 1 to 4 carbon atoms, or a carboxylic acid group; $R_3$ is hydrogen or an alkyl group having 1 to 4 carbon atoms; and $R_4$ is a hydroxyl group, an alkyl group having 1 to 4 carbon atoms, an alkoxy group having 1 to 4 carbon atoms, an aldehyde group, or a carboxylic acid group. Typical examples of this polymer are those described in British Pat. No. 1,491,978. A preferred polymer is a hydrolyzed polymaleic anhydride having a molecular weight of 2,500.

In general, the polymer is used in an amount of 0.05 to 5% by weight of the dishwashing composition, and preferably in an amount of 1 to 3%.

The $Ca^{2+}$ sequestering agent should preferably not form a precipitate of insoluble Ca-salts. I t may be an organic builder salt such as an water-soluble citrate, a water-soluble salt of nitrilotriacetic acid (NTA), a water-soluble salt of carboxy methyloxy succinic acid (CMOS), or other known builders such as zeolites, or it may be a salt of an organic chelating agent, such as ethane-1, 1-dihydroxy phosphonic acid, ethylene diamine tetraphosphonic acid, EDTA; and the like. Particularly preferred are citrates, NTA, CMOS and zeolites.

In general, the $Ca^{2+}$ sequestering agent is used in an amount of 5 to 50%, preferably 5 to 25% by weight of the dishwashing composition. The weight ratio between the organic sequestering agent and the polymer varies between 1 to 100, preferably between 1.5 to 10.

The dishwashing composition furthermore comprises alkaline materials. These alkaline materials include sodium hydroxide, salts such as alkalimental borates, alkali metal meta- or disilicates and alkalimetal silicates having a $Na_2O:SiO_2$ ratio of 1:3.4; alkalimetal carbonates; in this respect it is to be observed that the compositions of the invention are preferably phosphate-free, and contain sodium metasilicate as the alkaline detergent salt.

The compositions are substantially free from anionic synthetic detergents or fatty acid soaps. If desired, the compositions may contain a small amount of a non-ionic detergent surfactant (up to 5% by weight).

Furthermore, they may contain a chlorine bleaching agent such as alkalimetal hypochlorite, sodium or potassium dichlorocyanurate (up to 5% by weight), an oxygen releasing bleaching agent such as sodium perborate, with or without a bleach precursor such as tetraacetylethylenediamine, optionally together with an aminophosphonic acid such as ethylenediaminetetraphosphonic acid or a salt thereof, or other peracids. Optional ingredients such as solvents, perfumes, colouring agents, anti-corrosion agents, enzymes, clays, anti-redeposition agents etc. may also be present.

Although the invention is described mainly in the context of machine dishwashing compositions for the main wash, it is also applicable to rinse aid compositions.

The compositions of the present invention may be made in any physical form, such as powders, granulates, tablets, liquids etc.

EXAMPLE 1

Glass slides (4×5 cm) were washed ten times in a model experiment: a one liter aqueous solution containing 1.5 g/l of sodium carbonate and having a hardness of 8° GH., with or without 0.5 g/l of sodium citrate and an amount of polymer as indicated in the Table below, in which the glass slides are immersed, was heated from 20° to 65° C. in 20 minutes with stirring. The glasas slides were weighed before immersion and after they had been treated ten times with the above solution, and the weight increase is a measure of deposit of insoluble calcium salt.

The following results were obtained:

| Polymer added | Concentration polymer added (g/) | weight increase (mg) no citrate present | 0.5 g/l citrate |
|---|---|---|---|
| — | — | 16 | 18 |
| Sodium polyacrylate* | 0.03 | 13.5 | 15.2 |
| (MW 6,000) | 0.06 | 14.0 | 8.6 |
| Copolymer of maleic anhydride with methylvinylether* | 0.03 | 14.0 | 11.2 |
| (MW 50,000) | 0.06 | 12.6 | 9.4 |
| Hydrolysed polymaleic anhydride** | 0.015 | 13.0 | 0.6 |
| (MW 2,500) | | | |

*(acc. to prior. art)
**(acc. to invention)

This Example shows that the use of the combination according to the present invention yields results that are far superior to those of combinations containing another polymer than the hydrolysed polymaleic anhydride.

EXAMPLE 2

Examples 1 was repeated, using water of 16° GH., with a partly hydrolysed polymaleic anhydride (av.mol. weight 2,500) and a range of sodium citrate levels. The following results were obtained.

| Polymer (%) | Citrate (%) 0 | 5 | 10 | 15 | 20 | 25 | 30 |
|---|---|---|---|---|---|---|---|
| 0.5 | — | — | — | — | 14 | 7.8 | 0.6 |
| 1 | 25.8 | — | — | 6.8 | 11 | 0 | 0.5 |
| 1.5 | — | 14.9 | 22 | 0.3 | 0.5 | 0 | 0 |
| 2 | 11.6 | 9.1 | 0.5 | 0 | 0 | — | — |
| 2.5 | — | 0.9 | — | — | — | — | — |
| 3 | 0 | 0 | 0.7 | — | — | — | — |

(% = % on final product; dosage was 3 g/l)

EXAMPLE 3

In the same manner as in Example 1, the following systems were tested:

conditions: one liter of aqueous solution containing 1.5 g/l of sodium carbonate, 0.15 g/l of the $Ca^{2+}$ sequestering agent, and 0.015 g/l (A) or 0.030 g/l (B) of the hydrolysed polymaleic anhydride. The water had a hardness of 16° GH. (Ca:Mg ratio of 2:1).

The following Table gives the results:

| $Ca^{2+}$ Sequestering agent | Weight increase of glass slides in mg. A | B |
|---|---|---|
| — | 7.4 | 2.5 |
| EDTA | 4.1 | 0.4 |
| NTA | 3.6 | 0.5 |
| Sodium citrate | 4.1 | 0.9 |
| Na—Carboxymethyloxysuccinate | 4.3 | 0.8 |
| Dipicolinic acid | 4.5 | 0.6 |

EXAMPLE 4

In a commercial dishwashing machine several objects (of glass, stainless steel and plastic) were cleaned and rinsed, using water of 8° GH. and the normal programme. The main wash was carried out using 1.5 g/l of sodium carbonate and 1.0 g/l of sodium citrate, and the rinse was carried out with a commercial rinse aid composition in a dosage of 3 ml per wash. The total process was repeated 10 times. The results thereof were compared with those obtained under identical conditions, the only exception being that to the rinse aid composition 5% of hydrolysed polymaleic anhydride (MWA 2,500) was added. The following Table shows the results.

| Objects | Weight increase (mg) Rinse aid without polymer | with polymer |
|---|---|---|
| glass | 2 | 0.1 |
| stainless steel | 5 | 2 |
| plastic | 19 | 7 |

EXAMPLE 5

Example 1 was repeated, using 1 liter of an aqueous solution of the ingredients as indicated below. The average weight increase was determined, and the results are given in the Table. The treatment was carried out at a temperature of 25°-65° C. for 15 minutes; the water had a hardness of 30° GH. (Ca:Mg=1:1) and contained 0.45 g/l $NaHCO_3$. The results are the average of 4 experiments.

| Ingredients | g/l | | | |
|---|---|---|---|---|
| Sodium citrate | 0.90 | 0.90 | 0.15 | 0.15 |
| Sodium metasilicate | 1.50 | 1.50 | 1.50 | 1.50 |
| Sodium dichlorocyanurate | 0.06 | 0.06 | 0.06 | 0.06 |
| Nonionic detergent | 0.03 | 0.03 | 0.03 | 0.03 |
| Hydrolysed polymaleic anhydride | 0.06 | — | 0.06 | 0.09 |

-continued

| Ingredients | g/l | | | |
|---|---|---|---|---|
| Average weight increase | 4.6 | 14.3 | 11.5 | 6.6 |

We claim:

1. A machine dishwashing or rinsing composition being substantially free from anionic detergents and having a very low or zero phosphate content, which comprises:
   (a) from 5-50% by weight of a calcium sequestering agent selected from the group consisting of water-soluble citrate salts, water nitrilotriacetic acid salts, water-soluble carboxymethyloxy succinic acids salt, zeolites, ethane-1,1-dihydroxyphosphonic acid salts, ethylenediamine tetraphosphonic acid salts and ethylenediamine tetraacetic acid salts;
   (b) from 0.05-5% by weight of hydrolyzed polymaleic anhydride having an average molecular weight of about 2,500;
   (c) up to 5% by weight of a nonionic detergent surfactant; and
   (d) an alkaline detergent material selected from the group consisting of alkali metal hydroxides, alkali metal borates, alkali metal disilicates, alkali metal silicates having an alkali metal: $SiO_2$ ratio of 1:3.4, and alkali metal carbonates; the weight ratio between said sequestering agent and said hydrolyzed polymaleic anhydride being between 1:1 and 100:1.

2. A composition according to claim 1, comprising from 5 to 25% by weight of said sequestering agent; from 1-3% by weight of said hydrolyzed polymaleic anhydride; the weight ratio between said sequestering and said hydrolyzed polymaleic anhydride being between 1.5:1 and 10:1.

3. A composition according to claim 1, in which said alkaline detergent material is sodium metasilicate.

4. A composition according to claim 1 in which said calcium sequestering agent is sodium citrate.

* * * * *